US007670274B2

(12) United States Patent
Diehr et al.

(10) Patent No.: US 7,670,274 B2
(45) Date of Patent: Mar. 2, 2010

(54) FOLDING STATION WITH ADJUSTABLE FOLDING STRAP

(75) Inventors: Wolfgang Diehr, Grevenbroich (DE); Klaus Torka, Mönchengladbach (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 148 days.

(21) Appl. No.: 11/107,172

(22) Filed: Apr. 15, 2005

(65) Prior Publication Data

US 2005/0221968 A1 Oct. 6, 2005

(30) Foreign Application Priority Data

May 4, 2004 (DE) ..... 10 2004 022 342

(51) Int. Cl.
*B31B 1/58* (2006.01)
*B31F 1/08* (2006.01)

(52) U.S. Cl. ..... 493/182; 493/69; 493/70; 493/72; 493/422; 493/441

(58) Field of Classification Search ..... 493/68, 493/66, 72, 422, 441, 69, 70, 182
See application file for complete search history.

(56) References Cited

U.S. PATENT DOCUMENTS

| | | | | |
|---|---|---|---|---|
| 1,506,844 | A | 9/1924 | Bombard et al. | |
| 2,589,944 | A | 3/1952 | Labombarde | |
| 2,931,277 | A | 4/1960 | Bombard | |
| 3,797,370 | A * | 3/1974 | Sawada | 493/168 |
| 3,913,464 | A * | 10/1975 | Flaum | 493/142 |
| 4,121,506 | A * | 10/1978 | Van Grouw | 493/131 |
| 5,035,683 | A | 7/1991 | Takeda et al. | |
| 5,114,392 | A | 5/1992 | McAdam, III et al. | |
| 5,151,075 | A | 9/1992 | Beaulleu et al. | |
| 5,230,686 | A | 7/1993 | McAdam, III et al. | |
| 5,827,162 | A | 10/1998 | Rubin et al. | |
| 5,853,360 | A * | 12/1998 | Jeffrey et al. | 493/178 |
| 5,927,162 | A | 7/1999 | Huang | |
| 5,997,459 | A | 12/1999 | Kruger et al. | |
| 7,150,707 | B2 * | 12/2006 | Taubenheim | 493/71 |

FOREIGN PATENT DOCUMENTS

| | | |
|---|---|---|
| DE | 10 07 609 | 5/1957 |
| DE | 31 18 886 | 12/1982 |
| DE | 40 09 681 | 10/1990 |
| DE | 690 15 537 | 8/1995 |
| DE | 44 39 198 | 5/1996 |
| DE | 102 41 448 | 3/2004 |
| EP | 0 804 336 B1 | 11/1995 |
| JP | 2002-205347 | 7/2002 |

* cited by examiner

*Primary Examiner*—Rinaldi I. Rada
*Assistant Examiner*—Gloria R. Weeks
(74) *Attorney, Agent, or Firm*—Keating & Bennett, LLP

(57) ABSTRACT

A folding station of a folding box gluing machine for processing a blank having a middle piece and side pieces which are attached to sides of the middle piece and which are deflected upward and inward along folding grooves between the middle piece and the side piece across a folding line toward the lengthwise middle of the blank and then folded up in order to produce a folding boxes, includes a folding strap that deflects the side pieces and folds them upward. The folding strap is guided by a folding shunt, a positioning roller, and one or more deflection and pressure rollers. A distance between the folding strap from the folding line of the blank is adjustable, such that the folding strap acts on an outer region of the side piece.

11 Claims, 6 Drawing Sheets

FOLDING STATION WITH ADJUSTABLE FOLDING STRAP

BACKGROUND OF THE INVENTION

1. Field of the Invention

The present invention concerns a folding station of a folding box gluing machine for processing a blank delivered along a conveying section with a controllable delivery speed, wherein the blank has a middle piece on which side pieces are attached at the sides of the middle piece, which are folded inward along folding grooves between the middle piece and the side pieces, across a folding line toward the lengthwise middle of the blank and then folded up in order to produce the folded boxes, with a folding strap that folds the side pieces upward, being guided by a folding shunt, a positioning roller, and one or more deflection and pressure rollers.

2. Description of the Related Art

A known folding box machine used to transform blanks into folded box tubes is disclosed in DE 102 41 448. The blanks correspond to a view of a ready-to-produce folding box. The folding must be performed with precision, since the folding will determine the angle trueness of the finished folded box.

In order to produce the folded box tube, folding straps or folding bands are used and arranged to lie against portions of the blank being folded up, or the side pieces of the folding box blank, and maintain the folding along the folding line. The folding straps are arranged so as to have a helical shape and are arranged to operate on the portions being folded. To effectively perform the folding operation, the folding straps travel at a speed corresponding to the speed of the blank. In order to ensure the angle trueness of the finished folded box, a plurality of loosely turning disks are arranged in the folding line, and make contact with the folding box blank in the vicinity of the folding lines.

Another known folding station for folding blanks is disclosed in DE 44 39 198 A1. Folding is performed using folding straps, which engage the side flaps of a blank from underneath. The folding straps thus travel from a plane underneath the blank to a plane above the middle piece of the blank. The axes of the folding straps are twisted relative to each other so that the surface of the folding strap facing the blank rotates by a total of about 180 degrees along the delivery path of the blank. In order to maintain close tolerances during the folding of the blanks, an edging device is arranged in the region of the folding lines of the blanks in the forward region of the delivery path.

It is evident from the described state of the art that exact folding along the folding lines and maintaining angle trueness of the blanks after folding present problems with the conventional folding process.

SUMMARY OF THE INVENTION

To overcome the problems described above, preferred embodiments of the invention provide a folding box gluing machine which provides precise folding with minimal additional parts, and which enables adjustment of the folding station to accommodate diverse blanks in a flexible manner and with minimal expense.

A preferred embodiment of the present invention provides a folding box gluing machine in which the distance from the folding strap to the folding line of the blank is adjustable, such that the folding strap constantly works on an outer region of the side piece. Preferred embodiments of the present invention make it possible to grasp even the most diverse blanks in the region of the side pieces that is most favorable for folding to thereby assure precise folding. The adjustability of the folding strap relative to the folding line and thus to the particular length of the side piece of the blank, enables the optimal folding moment to be exerted on the blanks. The use of an adjustable modular suspension facilitates horizontal and vertical adjustment of the folding strap with respect to the direction of transport of the blanks.

Other features, elements, steps, characteristics and advantages of the present invention will become more apparent from the following detailed description of preferred embodiments with reference to the attached drawings.

DETAILED DESCRIPTION OF PREFERRED EMBODIMENTS

Figure 1:
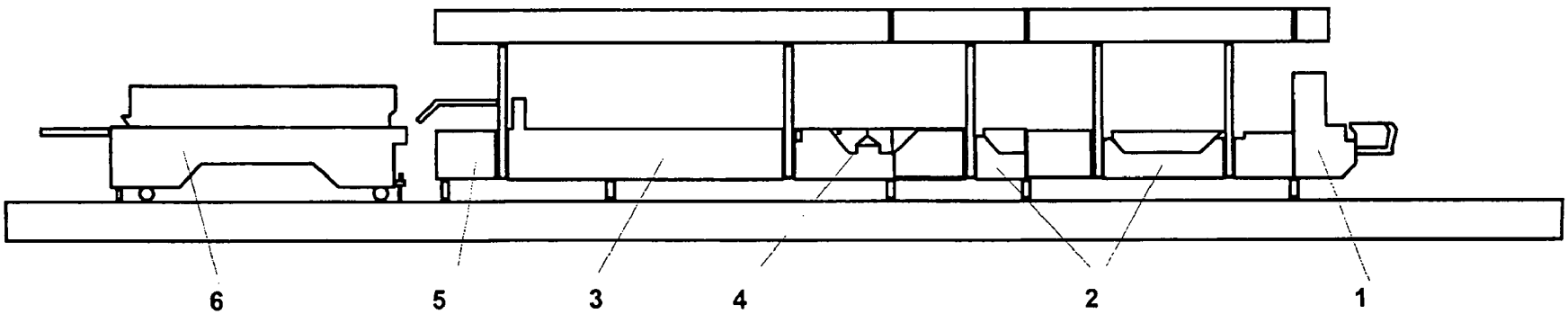
FIG. 1 shows a side view of a schematic layout of a folding box gluing machine according to a preferred embodiment of the present invention.

In the delivery direction, which runs from right to left in FIG. 1, the folding box gluing machine preferably includes an inserter 1 which pulls the blanks being processed one after the other from a stack at high speed and introduces them individually to the following processing stations. After the inserter 1, a primary breaker 2 is provided, which has two stages in the present preferred embodiment. The breaker 2 includes folding elements for folding side pieces or folding flaps forward and backward, so as to produce corresponding folding lines or lengthwise grooves which are soft and flexible by bending them through about 180 degrees. The two-stage configuration shown in FIG. 1 makes it possible to break several lengthwise and transverse grooves and produce additional folds. A folding station 3 is provided after the breaker 2, the folding station 3 includes an applicator 4 for applying adhesive, such as glue, arranged at the beginning of the folding station 3. The adhesive applicator 4 includes glue nozzles or glue disks, from which the glue is applied in a strip on the blanks. At the end of the folding station 3, the folded boxes are checked for folding mistakes. For this, photocells are arranged in this region, with which the length of the folded box is probed. If the length of the folding box does not correspond to a predetermined length, e.g., because a flap was not properly folded, this box is reported as defective to the central control unit of the folding box gluing machine.

Immediately next to the folding station 3 is the transfer station 5. The transfer station 5 feeds the folded boxes having not-yet-hardened glue seams to a collecting and pressing station 6. A stream of folded boxes is produced as they pass from the transfer station 5 to the collecting and pressing station 6. Therefore, the collecting and pressing station 6 includes pressing bands, by which the glue seams are maintained under pressure until the adhesive is securely set.

Figure 2:
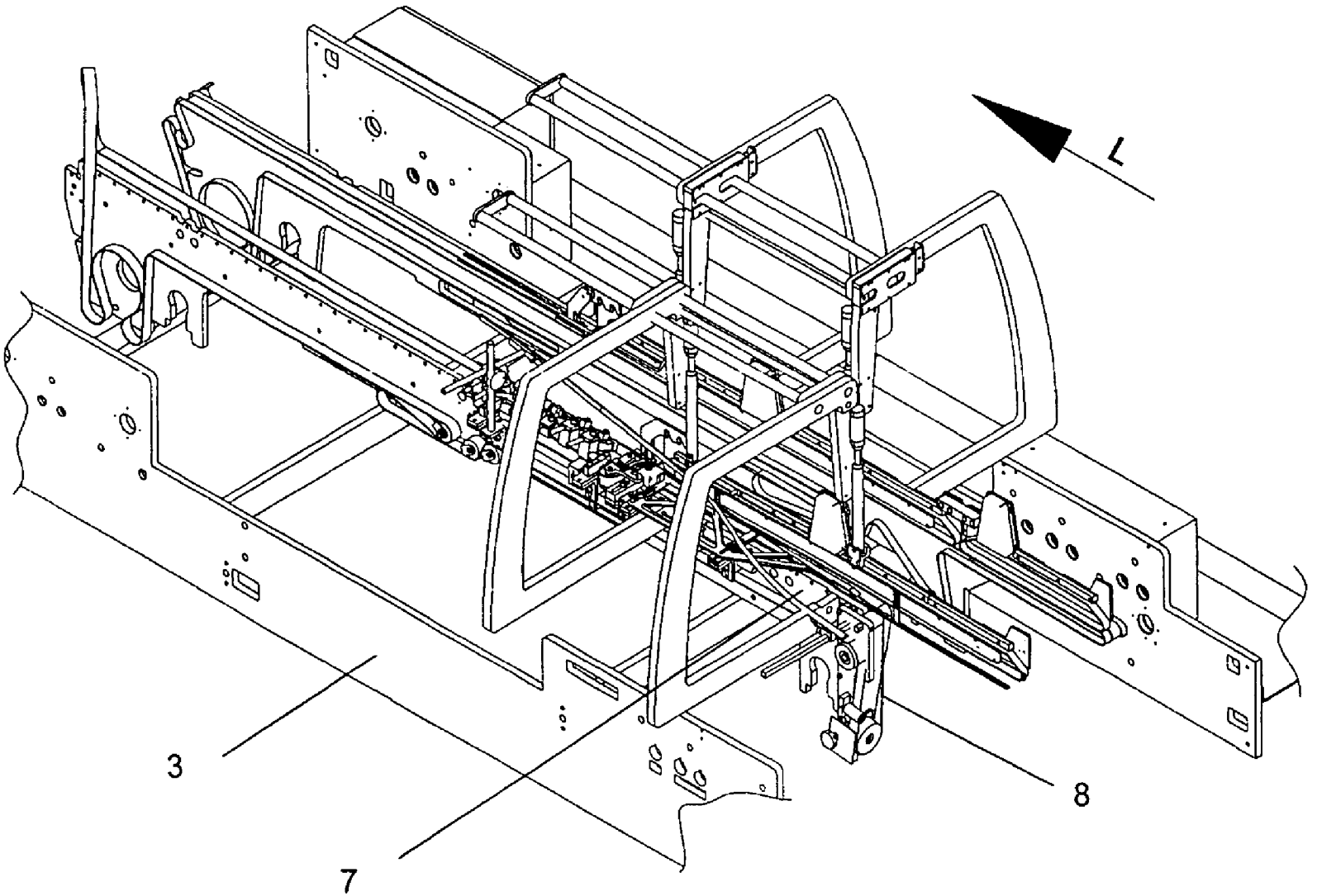
FIG. 2 shows a three dimensional view of the folding station of a folding box gluing machine according to a preferred embodiment of the present invention.

FIG. 2 shows a three dimensional view of a folding station 3, which includes a guide 7 for a folding strap 8 designed in accordance with a preferred embodiment of the present invention. FIG. 2 shows the arrangement of the guide 7 in the folding station 3, as well as the direction of travel L of the blanks through the folding box gluing machine.

Figure 3:
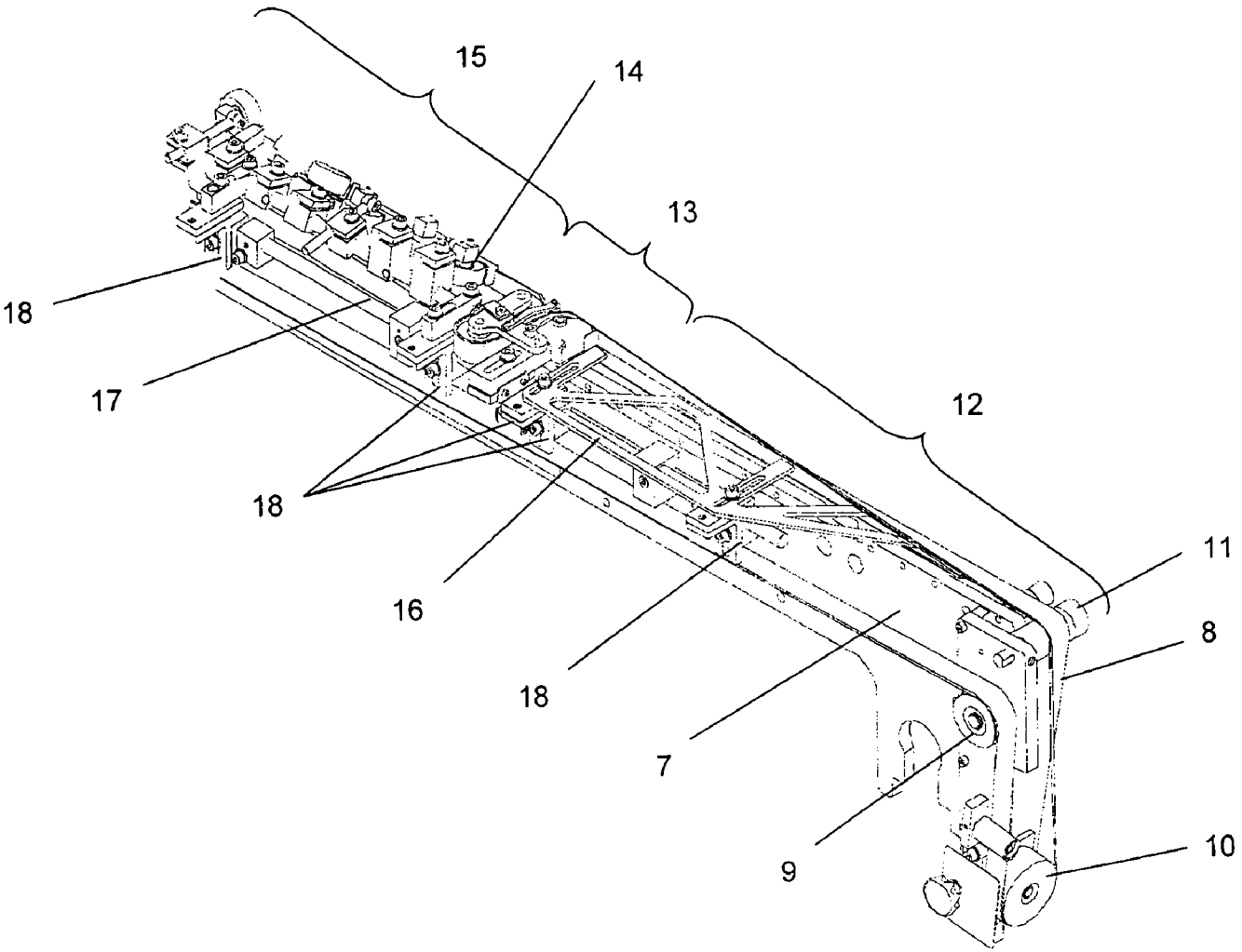
FIG. 3 shows a perspective view of a guide for a folding strap according to a preferred embodiment of the present invention.

FIG. 3 shows a magnified isometric view of the guide 7 shown in FIG. 2, which folds the side pieces. The guide 7 includes a folding strap 8, which is deflected by 90 degrees by a deflection roller 9 and guided across a positioning roller 10. From the positioning roller 10, the folding strap 8 travels across another deflection roller 11 and then across a first region of the folding station 12 to a deflection roller region located in a second region 13, where the folding strap 8 is guided around three deflection rollers (see FIG. 5). From the second region 13, the folding strap 8 is guided to a third region 15 around individually adjustable pressure rollers 14 such that, beginning with the deflection roller 11, the folding strap 8 is rotated by about 180 degrees along the entire path of the folding strap 8. After moving through the system of several deflection rollers 14 arranged in the third region 15, the folding strap 8 returns to the deflection roller 9 in the first region 12 of the folding station 3.

In the first region 12, the side piece of the blank, lying flat on the folding strap 8 at the beginning of the folding station, is rotated through about 90 degrees to a perpendicular position. The perpendicular position, also designated below as the vertical direction, is relative to the transport direction of the blanks, from the start of the folding station at the deflection roller 11 to the end of the third region 15.

In the first region 12, the folding strap 8 is deflected through about 90 degrees by a folding shunt 16. The deflection of the folding strap 8 pushes up the side piece of the blank by about 90 degrees. Thus, the side piece is situated at a right angle to the plane of the transport direction and is perpendicular to the middle piece of the blank. The middle region 13 follows the first region 12, and includes three deflection rollers defined by triple roller 13' (see FIG. 5). These deflection rollers stabilize the guidance of the folding strap 8. In the third and last region 15 of the folding station 3, the folding strap 8 is guided across a number of pressure rollers 14 through about another 90 degrees in the direction of the plane of the flat lying region of the blanks.

Figure 4:
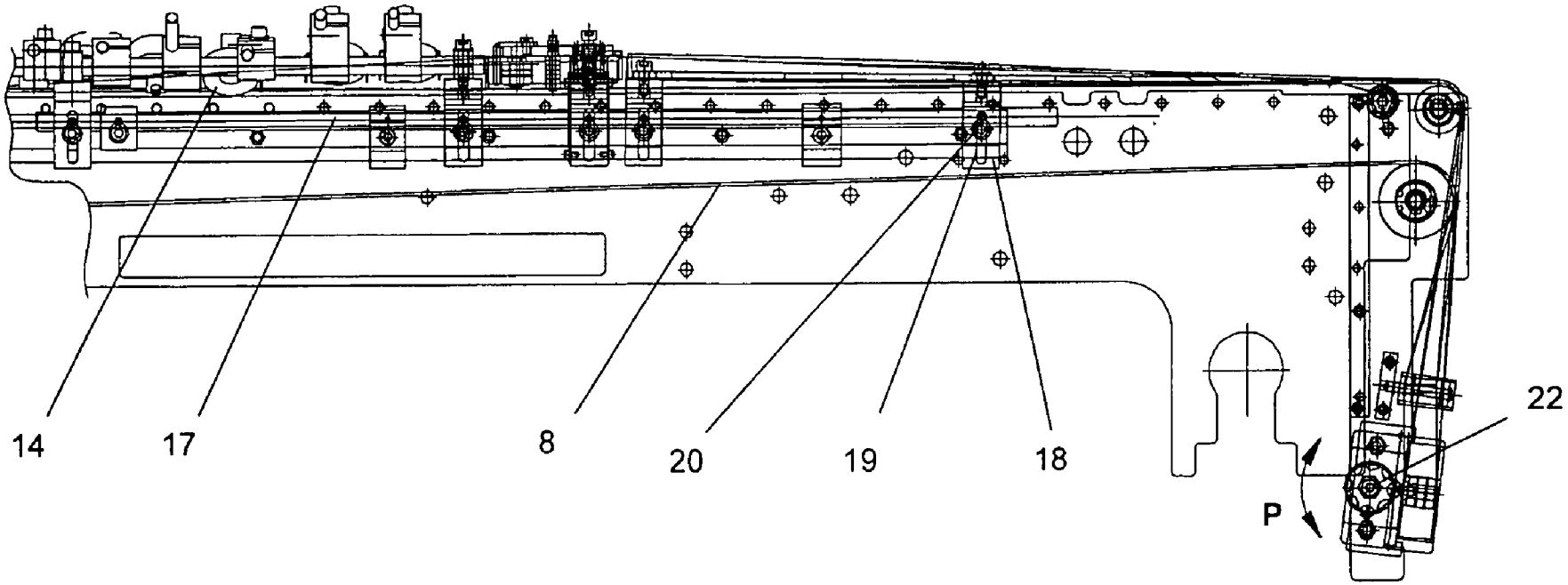
FIG. 4 shows a side view of the guide shown in FIG. 3.
Figure 5:
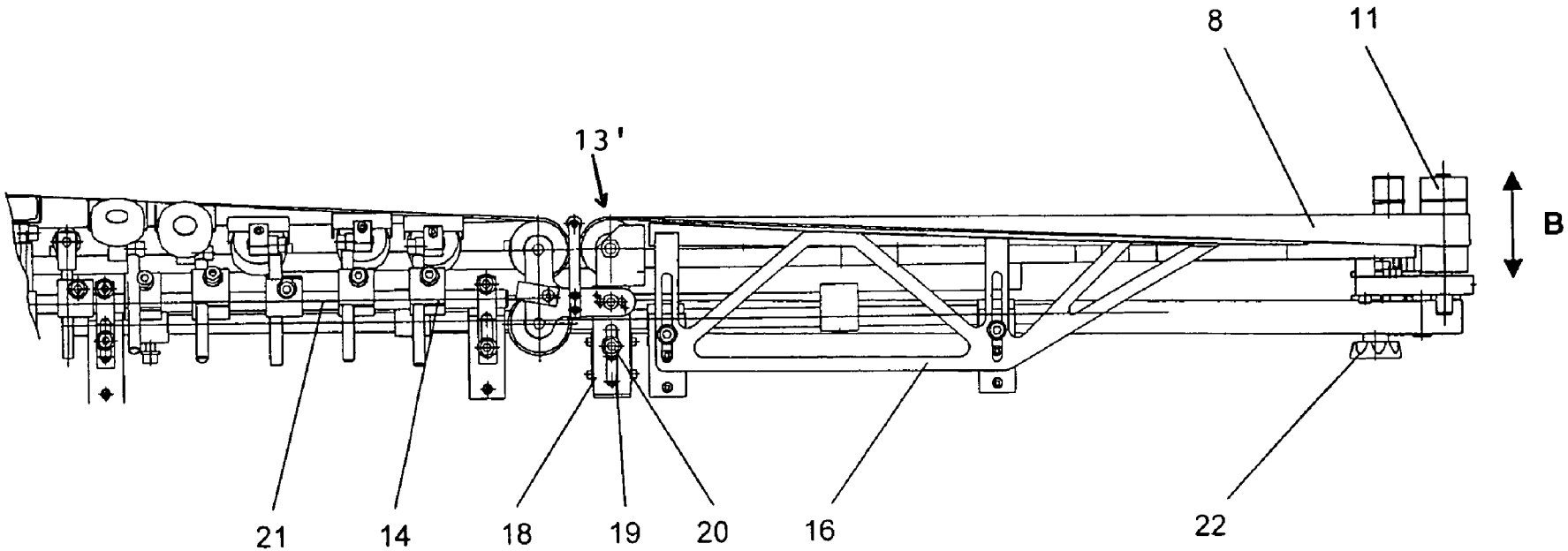
FIG. 5 shows a top view of the guide shown in FIG. 3.

According to the preferred embodiment of the present invention, the folding strap 8 is configured to be adjustable with respect to the folding line. For this, folding shunt 16, triple roller 13' and the pressure rollers 14 are mounted on a linear guide 17 by adjustment devices 18. The adjustment devices 18 enables horizontal and vertical adjustment of the folding shunt 16, the triple roller 13' and the pressure rollers 14. The adjustment devices 18 are freely adjustable in the preferred embodiment, and include screws 20 arranged in slots 19, see FIGS. 4 and 5. However, any suitable adjustment device could be used. For clarity, only one adjustment device 18 is designated by the reference numbers 19, 20. The other adjustment devices 18 may also include slots 19 and screws 20. The folding shunt 16 is likewise provided with longitudinal holes 19. By placing the pressure rollers 14 on a separate carriage 21, as shown in FIG. 5, it is very easy to adjust the pressure rollers 14. The triple roller 13' and the folding shunt 16 are also mounted in a similar manner and are easily adjustable. As shown in FIGS. 4 and 5, adjustment is clearly obtained using the slots 19.

Figure 6:
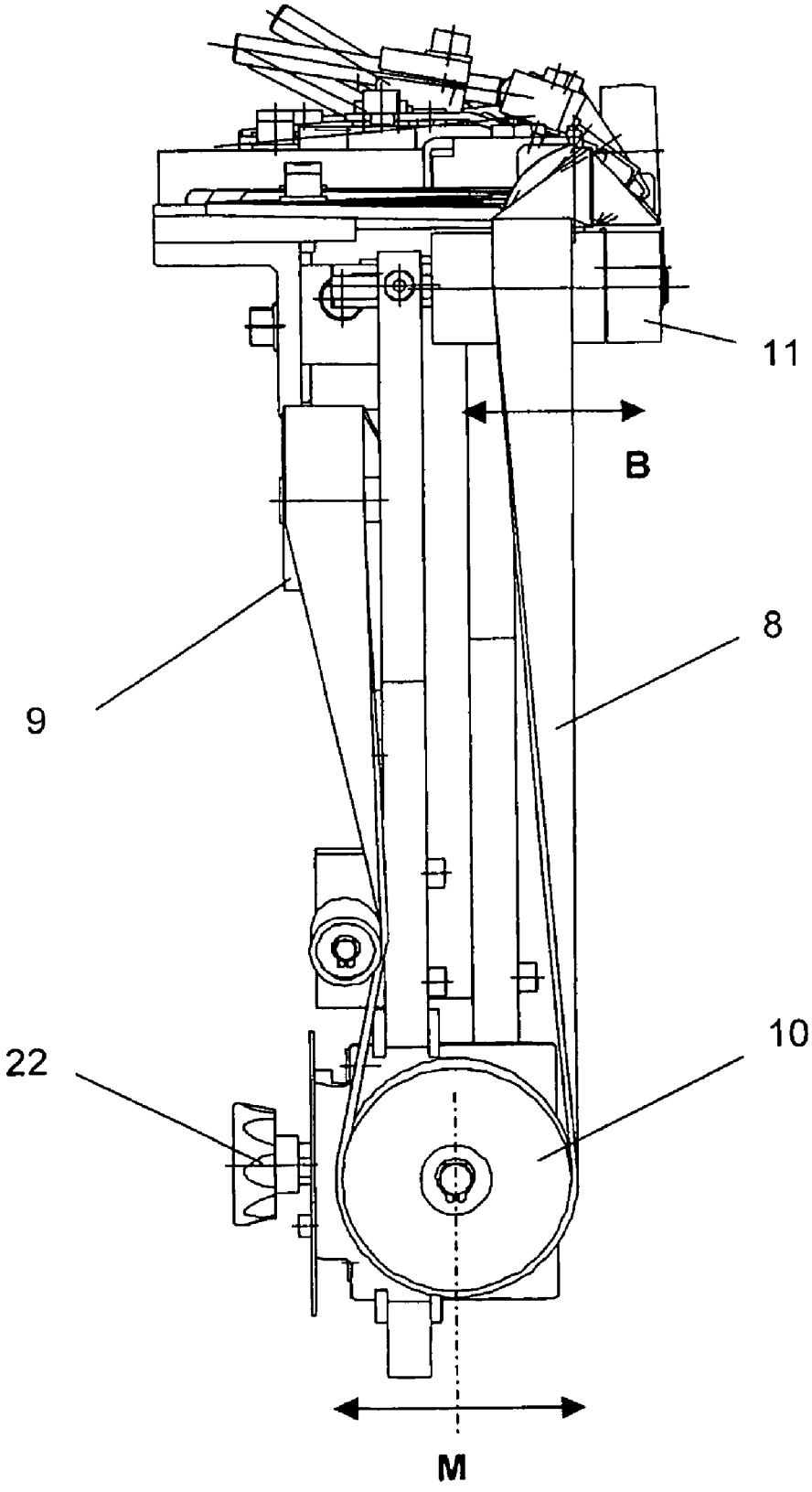
FIG. 6 shows a front view of the guide for the folding strap shown in FIG. 3.

To ensure that the folding strap 8 optimally engages with the side pieces of the blanks in the entry zone of the blanks, the location of the positioning roller 10 is also adjustable. The folding strap 8 is fed over the deflection roller 9 to the positioning roller 10. The location of the positioning roller 10 can be changed by a spindle drive with a set screw 22, which turns in the direction of the arrow P. The adjustment will be explained using FIG. 6 as an example. If the position of the positioning roller 10 is changed by the set screw 22, as indicated by the arrow M, the folding strap 8 will migrate across the deflection roller 11 in the direction of the arrow B. This enables adjustment of the folding strap 8 to the proper location on the side pieces to be folded via a very simple device when the blanks are fed in.

Adjustment of the folding strap 8 provides the advantage of optimal folding of the boxes in the region of the finished folding station 3. It is always preferable to apply the folding strap 8 as far away from the folding line or groove line as possible, in order to minimize deviations from the angle-true folding, also known as fish-tailing, and to provide an optimal operating location. In all known folding box gluing machines, the operating location of the folding strap always lies in the immediate vicinity of and directly on the groove line of the bend. The present invention provides for adjustment of the folding strap 8 sideways in the forward starting region 12. In the following folding shunt 16, where the folding strap 8 is twisted from about 0 degrees to about 90 degrees, the folding shunt 16 is secured to the side in the forward region and adjustable in height in the rear region.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A folding station of a folding box gluing machine for processing a blank delivered in a transport direction along a conveying section with a controllable delivery speed, wherein the blank has a middle piece and side pieces attached to sides of the middle piece at a folding line, the folding station comprising:

a folding strap that deflects the side pieces upward and folds the side pieces;

a folding shunt;

a positioning roller;

at least three deflection rollers; and at least one pressure roller; wherein said folding strap is guided by said folding shunt, said positioning roller, said at least three deflection rollers and said at least one pressure roller;

said folding shunt, said positioning roller, said at least three deflection rollers, and said at least one pressure roller are arranged such that a distance between the folding strap and the folding line of the blank is adjustable;

the deflecting of the side pieces of the blanks by the folding strap occurs in a first region from about 0 degrees to about 90 degrees by said folding shunt, the folding occurs in a third region from about 90 degrees to about 180 degrees by said at least one pressure roller, and between the first region and the third region the folding strap is guided around said at least three deflection rollers in a second region located between said first and third regions in which the side pieces of the blanks are not deflected by the folding strap;

said first, second and third regions guiding the folding strap are each separately adjustable vertically and horizontally;

the horizontal adjustment of the first, second and third regions includes linear displacement of the first, second and third regions in a substantially horizontal direction;

at least two of the at least three deflection rollers are disposed along a transport path along which the blanks are transported and at least another one of the at least three deflection rollers is spaced away from the transport path, such that the folding strap is first guided away from the transport path and then guided back toward the transport path; and said positioning roller is arranged below a transport path of the folding station along which the blank is transported, the folding strap runs off said positioning roller and is guided across another deflection roller into the transport plane, a lengthwise axis of said positioning roller being displaced by about 90 degrees relative to a lengthwise axis of said another deflection roller, and said positioning roller is arranged to be adjusted transversely to its lengthwise axis.

2. A folding station according to claim 1, wherein said first, second and third regions guiding the folding strap are mounted jointly on a linear guide via separate adjustment devices.

3. A folding station according to claim 2, wherein the separate adjustment devices are arranged to adjust horizontally and vertically said folding shunt, said at least three deflection rollers, and said at least one pressure roller, respectively.

4. A folding station according to claim 1, wherein said another deflection roller and said positioning roller are arranged such that said folding strap is deflected by about 90 degrees by said another deflection roller and guided across said positioning roller.

5. A folding station according to claim 1, wherein the first region including the another deflection roller, the second region including the at least three deflection rollers, and the third region including the at least one pressure roller are arranged to guide the folding strap.

6. A folding station according to claim 1, wherein said folding strap is guided by said folding shunt, said positioning roller, said another deflection roller, said at least three deflection rollers, and said at least one pressure roller such that said folding strap is rotated by about 180 degrees along an entire path of the folding strap.

7. A folding station according to claim 1, wherein a position of at least one of said folding shunt, said positioning roller, said at least three deflection rollers, and said at least one pressure roller is adjustable.

8. A folding station according to claim 1, wherein a position of each of said folding shunt, said positioning roller, said at least three deflection rollers and said at least one pressure roller is adjustable.

9. A folding station according to claim 1, wherein the folding strap is arranged to be adjusted sideways in a forward starting region of the folding station.

10. A folding station according to claim 1, wherein the folding strap is arranged to be applied to the blank a maximum distance away from the folding line.

11. A folding box gluing machine comprising:

an inserter;

a primary breaker;

a folding station according to claim 1;

a transfer station; and a pressing station.

* * * * *